US008267444B2

(12) United States Patent
Akizuki et al.

(10) Patent No.: US 8,267,444 B2
(45) Date of Patent: Sep. 18, 2012

(54) DOOR LOCK APPARATUS FOR VEHICLE

(75) Inventors: Ryujiro Akizuki, Kariya (JP); Takashi Nishio, Kariya (JP); Kazumasa Seo, Nisshin (JP); Yusuke Yamada, Chiryu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 1083 days.

(21) Appl. No.: 12/184,639

(22) Filed: Aug. 1, 2008

(65) Prior Publication Data

US 2009/0051173 A1 Feb. 26, 2009

(30) Foreign Application Priority Data

Aug. 24, 2007 (JP) ..... 2007-218264

(51) Int. Cl.
*E05C 3/06* (2006.01)
*E05C 3/16* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS 5,092,638 A * 3/1992 Mizuki ..... 292/216
6,079,757 A * 6/2000 Aubry ..... 292/201
6,343,817 B1 * 2/2002 Watanabe ..... 292/216
6,406,073 B1 * 6/2002 Watanabe ..... 292/216
6,634,682 B2 * 10/2003 Fukunaga et al. ..... 292/216
7,055,872 B2 * 6/2006 Hayakawa et al. ..... 292/216
7,874,599 B2 * 1/2011 Suzumura et al. ..... 292/216
7,926,857 B2 * 4/2011 Akizuki et al. ..... 292/201
2004/0262927 A1 * 12/2004 Fukunaga et al. ..... 292/216
2005/0023840 A1 * 2/2005 Fukunaga et al. ..... 292/201
2006/0186675 A1 * 8/2006 Suzumura et al. ..... 292/216

FOREIGN PATENT DOCUMENTS

JP 2004-124687 A 4/2004

* cited by examiner

*Primary Examiner* — Carlos Lugo
*Assistant Examiner* — Alyson M Merlino
(74) *Attorney, Agent, or Firm* — Buchanan Ingersoll & Rooney PC

(57) ABSTRACT

A door lock apparatus for a vehicle includes a latch mechanism, an open operation lever, an open lever operatively connected to the open operation lever, a locking lever being switchable between an unlocked position and a locked position, a link operation lever operatively connected to the locking lever, a link member operatively connected to the link operation lever, the link member being able to transmit an operation of the open lever to the latch mechanism when the locking lever is in the unlocked position, the link member being unable to transmit the operation of the open lever to the latch mechanism when the locking lever is in the locked position, and a lever member operatively connected to the open lever and the locking lever, the lever member moving the locking lever from the locked position to the unlocked position by means of the operation of the open lever.

16 Claims, 5 Drawing Sheets

DOOR LOCK APPARATUS FOR VEHICLE

CROSS REFERENCE TO RELATED APPLICATIONS

This application is based on and claims priority under 35 U.S.C. §119 to Japanese Patent Application No. 2007-218264, filed on Aug. 24, 2007, the entire content of which is incorporated herein by reference.

FIELD OF THE INVENTION

This invention generally relates to a door lock apparatus for a vehicle.

BACKGROUND

A known door lock apparatus for a vehicle is disclosed, for example, in JP2004124687A. According to the door lock apparatus disclosed, a locked state and an unlocked state of a vehicle door relative to a vehicle body are switched in a state where the vehicle door is retained in a closed state relative to the vehicle body by means of a latch mechanism. In the unlocked state, the vehicle door can be opened, i.e., the closed state of the vehicle door can be cancelled, by an operation of a door handle. In the locked state, the vehicle door cannot be opened, i.e., the closed state of the vehicle door cannot be cancelled, by the operation of the door handle.

When an inside handle is operated one time in the locked state of the vehicle door, for example, a cancel lever is operated via an open operation lever and an open lever. Then, a link member moves on a lift lever by means of an operating force transmitted from the open lever and the cancel lever. At this time, the lift lever is not operated and therefore the closed state of the vehicle door retained by the latch mechanism is not cancelled.

On the other hand, a locking lever that receives an operating force via the link member and an inside locking lever is movable from a locked position to an unlocked position because of a deformation of a spring. When the inside handle is returned to its initial position, the state where the link member is positioned on the lift lever is cancelled, thereby obtaining the unlocked state of the vehicle door.

When the inside handle is further operated one more time in the aforementioned state, the lift lever is operated to thereby cause a cancellation of the closed state of the vehicle door that is retained by the latch mechanism.

A transmission path of the operating force via the open operation lever and the open lever when the locking lever is moved from the locked position to the unlocked position by an operation of the inside handle is constituted by the cancel lever, the link member, and the inside locking lever. In this case, since the transmission path is constituted by three members, the transmission efficiency of the operation force may be reduced, which may lead to deterioration in the operation feeling of the inside handle.

Lately, the door lock apparatus provided at the vehicle door not equipped with a lock knob that links to a function of the inside locking lever, i.e., a knob-less door, has also been proposed. The inside locking lever is not necessary for such door lock apparatus. However, even when the door lock apparatus is applied to such type of door, the aforementioned transmission path is constituted by two members, which may still lead to the decrease in the transmission efficiency of the operation force of the inside handle.

A need thus exists for a door lock apparatus for a vehicle which is not susceptible to the drawback mentioned above.

SUMMARY OF THE INVENTION

According to an aspect of the present invention, a door lock apparatus for a vehicle includes a latch mechanism retaining a vehicle door in a closed state relative to a vehicle body, an open operation lever adapted to operate by means of an operation of a door handle provided at the vehicle door, an open lever operatively connected to the open operation lever, a locking lever being switchable between an unlocked position and a locked position, a link operation lever operatively connected to the locking lever by means of a biasing member, a link member arranged between the latch mechanism and the open lever and operatively connected to the link operation lever, the link member being able to transmit an operation of the open lever to the latch mechanism when the locking lever is in the unlocked position, the latch mechanism being operated to bring the vehicle door to be in an open ready state relative to the vehicle body, the link member being unable to transmit the operation of the open lever to the latch mechanism when the locking lever is in the locked position, and a lever member operatively connected to the open lever and the locking lever, the lever member moving the locking lever from the locked position to the unlocked position by means of the operation of the open lever.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
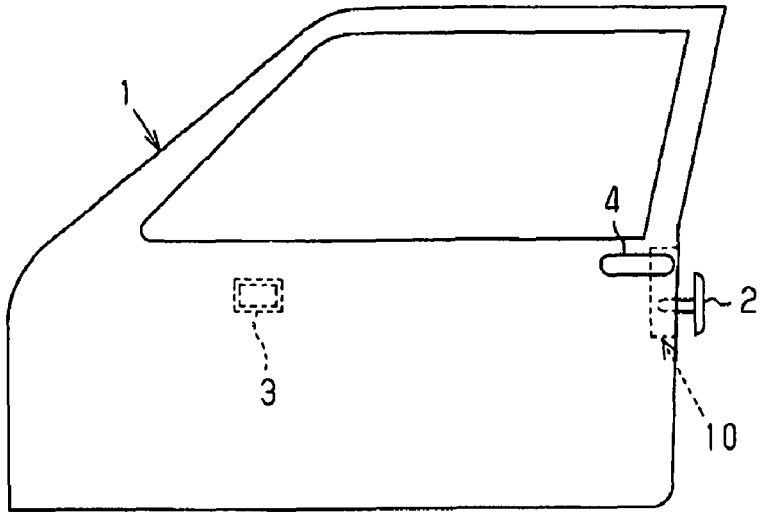
FIG. 1 is a front view of a vehicle door to which a door lock apparatus for a vehicle according to an embodiment of the present invention is applied.

An embodiment of the present invention will be explained with reference to the attached drawings. As illustrated in FIG. 1, a door lock apparatus 10 is provided within a vehicle door 1, specifically, in the vicinity of a rear edge thereof. The door lock apparatus 10 holds the vehicle door 1 in a closed state relative to a vehicle body (not shown) by an engagement with a striker 2 provided at the vehicle body. An inside handle 3 serving as a door handle is arranged at the vehicle door 1 so as to be exposed to an interior of a vehicle. An outside handle 4 is also provided at the vehicle door 1 so as to be exposed to an exterior of the vehicle.

Figure 2:
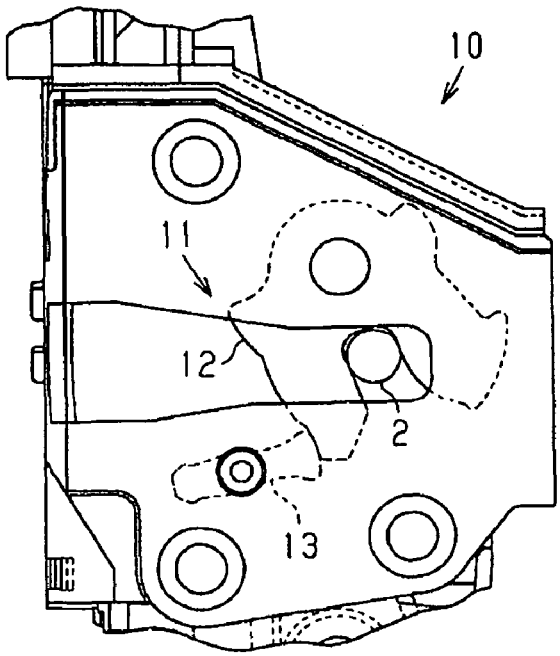
FIG. 2 is a elevation view illustrating a latch mechanism of the door lock apparatus according to the embodiment of the present invention.

As illustrated in FIG. 2, the door lock apparatus 10 includes a latch mechanism 11 having a latch 12 and a pawl 13. The latch mechanism 11 engages with the striker 2, thereby retaining the closed state of the vehicle door 1 relative to the vehicle body. That is, when closing the vehicle door 1, the latch 12 rotates to engage with the striker 2. At the same time, the pawl 13 prevents the rotation of the latch 12 so as to retain the closed state of the vehicle door 1. When the pawl 13 is moved to stop preventing the rotation of the latch 12, the latch 12 is biased by a return spring (not shown) to rotate in a return direction. Then, the engagement between the latch 12 and the striker 2 is cancelled to thereby bring the vehicle door 1 to an open ready state.

Figure 3:
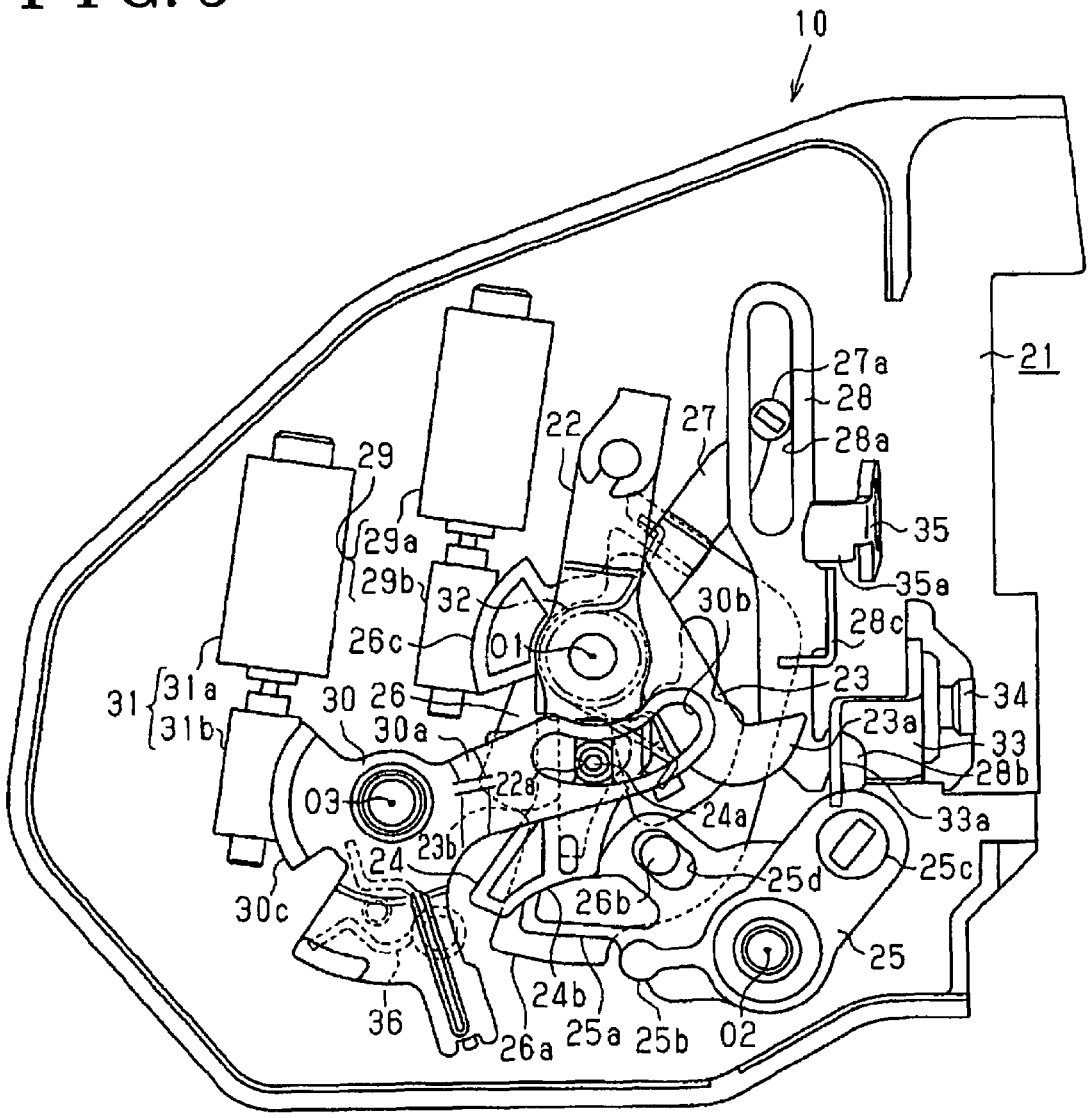
FIG. 3 is a side view illustrating the door lock apparatus and its operation.
Figure 4:
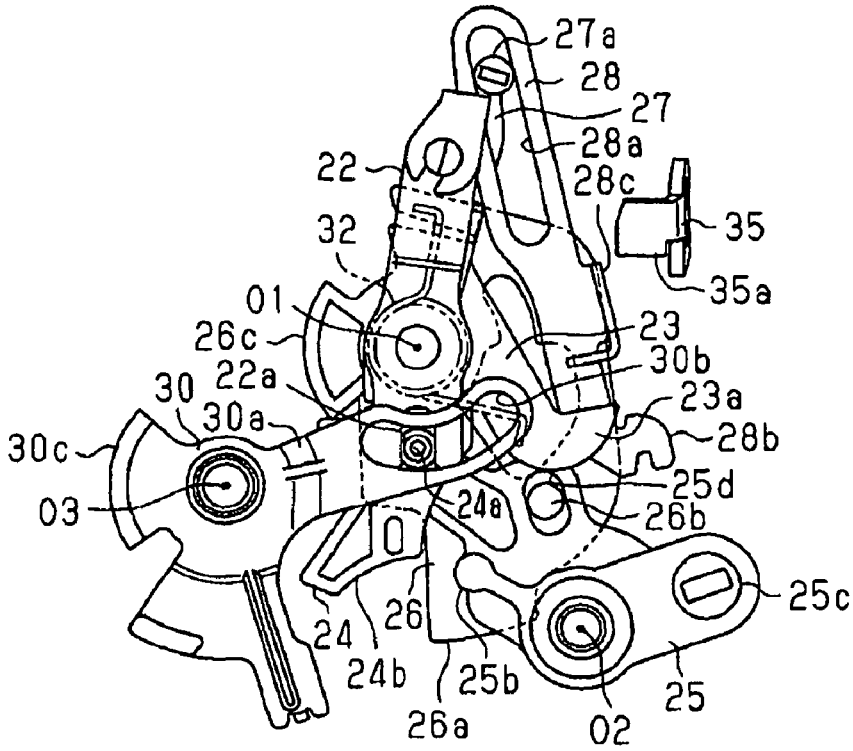
FIG. 4 is a side view illustrating the door lock apparatus and its operation.

The door lock apparatus 10 will be explained in detail with reference to FIGS. 3 to 8. FIG. 3 illustrates the door lock apparatus 10 in the case that the vehicle door 1 is in an unlocked state and a child lock unset state where the vehicle door 1 is allowed to open by an operation of the inside handle 3. FIG. 4 illustrates the door lock apparatus 10 in the case that the vehicle door 1 is in a locked state and the child lock unset state.

As illustrated in FIG. 3, the door lock apparatus 10 includes a housing 21 having a box shape, an inside lever 22 serving as an open operation lever, an inside open lever 23 serving as an open lever, a bush 24 serving as a block member, a cancel lever 25 serving as a lever member, an active lever 26 serving as a locking lever, a panic lever 27 serving as a link operation lever, an open link 28 serving as a link member, a lock actuator 29, a child lock lever 30, and a child lock actuator 31.

The inside lever 22 is formed by a metallic plate, for example, and is arranged at a predetermined initial position. The inside lever 22 is supported at the housing 21 so as to be rotatable about a rotational axis 01 in a clockwise direction and a counterclockwise direction in FIG. 3. The inside lever 22, which is connected to the inside handle 3, rotates in the counterclockwise direction in FIG. 3 when the inside handle 3 is operated in an open direction. The inside lever 22 includes an engagement groove 22*a* at an end that is cut towards the rotational axis 01 to form a substantially U-shape.

The inside open lever 23 is formed by a metallic plate, for example, and is arranged to be coaxial with the inside lever 22. The inside open lever 23 is supported at the housing 21 so as to be rotatable in the clockwise direction and the counterclockwise direction in FIG. 3. The inside open lever 23 includes a push piece 23*a* radially extending and having a claw shape, and a guide piece 23*b* radially extending at an angular position different from that of the push piece 23*a*.

The bush 24 is formed by a resin material into a flat plate shape, for example. The bush 24 is supported at the guide piece 23*b* in a slidable manner along a longitudinal direction (i.e., radial direction) of the guide piece 23*b*. The bush 24 includes an engagement projection 24*a* having a substantially column shape and extending in a vertical direction, i.e., substantially in parallel with the rotational axis 01. In cases where the bush 24 is arranged at a predetermined position close to the rotational axis 01 relative to the guide piece 23*b*, the engagement projection 24*a* is inserted into the engagement groove 22*a* of the inside lever 22 so as to restrict a relative movement of the bush 24 to the inside lever 22 in a circumferential direction relative to the rotational axis 01. At this time, the bush 24 is able to transmit a movement (i.e., rotation) of the inside lever 22 to the inside open lever 23. The bush 24 is in a child unlock position accordingly.

On the other hand, when the bush 24 is arranged at a predetermined position away from the rotational axis 01 relative to the guide piece 23*b* (see FIG. 8), the engagement projection 24*a* is retracted from the engagement groove 22*a* to thereby cancel the restriction of the relative rotation of the bush 24 to the inside lever 22. At this time, the bush 24 is unable to transmit the movement (i.e., rotation) of the inside lever 22 to the inside open lever 23. The bush 24 is in a child lock position accordingly. That is, the bush 24 is displaced along the guide piece 23*b* so as to selectively switch between a state where the inside lever 22 and the inside open lever 23 are allowed to integrally rotate and a state where the inside lever 22 and the inside open lever 23 are allowed to relatively rotate to each other. A press surface 24*b* is formed at an end portion of the bush 24 away from the rotational axis 01 by cutting in an arc shape and facing the cancel lever 25.

The cancel lever 25 is formed by a combination of a resin material and a metallic plate, for example. The cancel lever 25 is supported at the housing 21 so as to be rotatable about a rotational axis 02 in the clockwise direction and the counterclockwise direction in FIG. 3. The cancel lever 25 includes a connection portion 25*a*, an extending portion 25*b*, and an input portion 25*c*. The connection portion 25*a* has a plate shape extending towards the active lever 26. The extending portion 25*b* radially extends from the rotational axis 02 towards the bush 24. The input portion 25*c* radially extends from the rotational axis 02 in an opposite direction to that the extending portion 25*b* extends.

Figure 5:
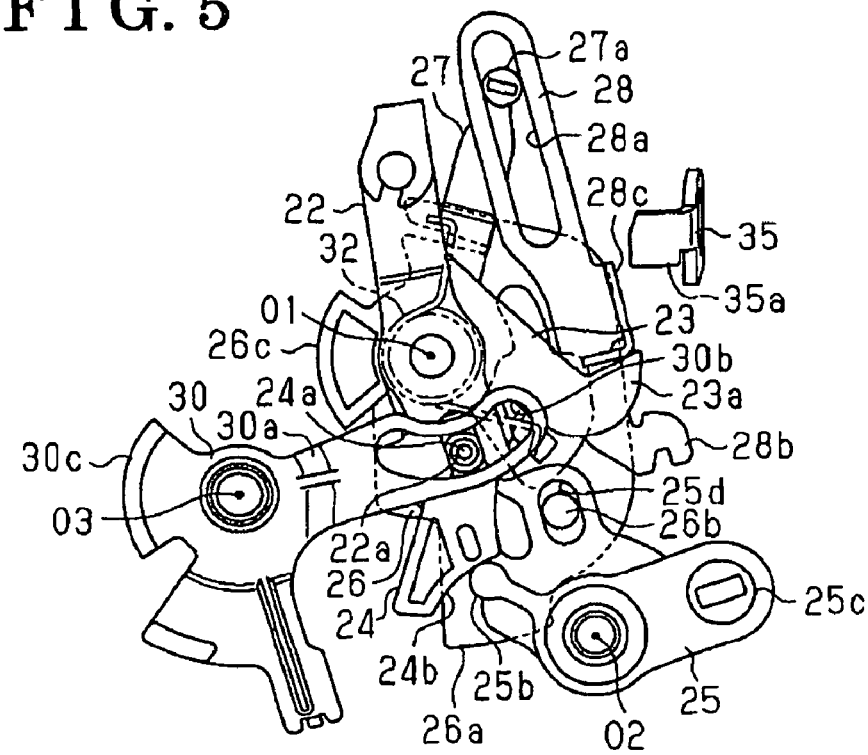
FIG. 5 is a side view illustrating the door lock apparatus and its operation.
Figure 7:
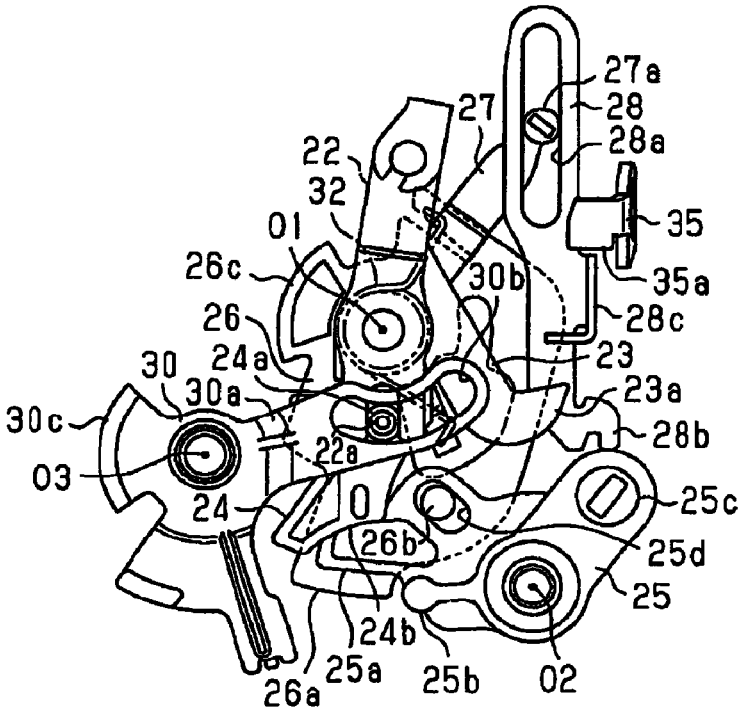
FIG. 7 is a side view illustrating the door lock apparatus and its operation.

In cases where the vehicle door 1 is in the locked state and the bush 24 is in the child unlock position as illustrated in FIG. 4, the extending portion 25*b* of the cancel lever 25 is pressed by the press surface 24*b* of the bush 24 resulting from the counterclockwise rotation of the inside open lever 23 that supports the bush 24 beyond a predetermined angle as illustrated in FIG. 5, thereby rotating the cancel lever 25 in the counterclockwise direction in FIG. 5. Further, in cases where the vehicle door 1 is in the unlocked state as illustrated in FIG. 7, the cancel lever 25 rotates in the clockwise direction in FIG. 7 by directly receiving an operating force from the outside of the door lock apparatus 10 via the input portion 25*c*. The connection portion 25*a* includes an elongated bore 25*d* that extends in a radial direction of the rotational axis 02.

The active lever 26 is formed by a resin material, for example, and is supported at the housing 21 so as to be rotatable about the rotational axis 01 in the clockwise direction and the counterclockwise direction in FIG. 3 within a predetermined rotational angle. The active lever 26 is in an unlocked position where the clockwise rotation of the active lever 26 is restricted as illustrated in FIGS. 3 and 7. On the other hand, the active lever 26 is in a locked position where the counterclockwise rotation of the active lever 26 is restricted as illustrated in FIG. 4. The active lever 26 is selectively moved to the unlocked position and the locked position by means of a biasing force of a spring for positioning the active lever 26 (not shown) assembled onto the housing 21.

The active lever 26 includes a lever portion 26*a*, a connecting projection portion 26*b*, and a gear portion 26*c*. The lever portion 26*a* having a plate shape extends from its rotational center, i.e., the rotational axis 01, towards the connection portion 25*a* to be arranged under the connection portion 25*a*. The connecting projection portion 26*b* projects from the lever portion 26*a* in a vertical direction, i.e., substantially in parallel with the rotational axis 01, to be inserted into the elongated bore 25*d* of the cancel lever 25. The gear portion 26*c* having a fan shape extends from the rotational center towards the lock actuator 29. The lock actuator 29 includes an electric motor 29*a* and an output gear portion 29*b* fixed to a rotational shaft of the electric motor 29*a* as illustrated in FIG. 3. The gear portion 26*c* meshes with the output gear portion 29*b* so that the active lever 26 and the lock actuator 29 are connected to each other. The active lever 26 is selectively moved to the unlocked position and the locked position by means of a driving force of the lock actuator 29.

The cancel lever 25 and the active lever 26 operatively connected through the connecting projection portion 26*b* positioned into the elongated bore 25*d* integrally rotate in such a manner that the cancel lever 25 and the active lever 26 rotate about respective rotational axes 02 and 01. Thus, in cases where the active lever 26 rotates between the unlocked position and the locked position about the rotational axis 01, for example, the cancel lever 25 rotates between an unlocked position and a locked position about the rotational axis 02 in association with the rotation of the active lever 26. On the other hand, in cases where the cancel lever 25 rotates about the rotational axis 02, the active lever 26 rotates about the rotational axis 01 in association with the rotation of the cancel lever 25. At this time, the active lever 26 is selectively moved to the unlocked position and the locked position by the biasing force of the aforementioned spring.

The panic lever 27 is formed by a metallic plate, for example, and is supported at the housing 21 so as to be rotatable about the rotational axis 01 in the clockwise direction and the counterclockwise direction in FIG. 3. The panic lever 27 is configured to basically integrally rotate with the active lever 26 by means of a spring 32 serving as a biasing member wound around the rotational axis 01. One end of the spring 32 engages with the active lever 26 and the other end engages with the panic lever 27. In this case, however, the active lever 26 and the panic lever 27 are relatively rotatable to each other about the rotational axis 01 against the biasing force of the spring 32. The panic lever 27 includes an engagement pin 27*a* at an end that extends in a vertical direction, i.e., substantially in parallel with the rotational axis 01.

The open link 28 is formed by a metallic plate, for example. The open link 28 that extends in up and down directions in FIG. 3 includes an elongated-shaped engagement groove 28*a* at one end through which the engagement pin 27*a* of the panic lever 27 is inserted. The open link 28 is slidable relative to the panic lever 27 along the longitudinal direction of the engagement groove 28*a*.

The open link 28 also includes a connection portion 28*b* at the other end operatively connected to an open lever 33 provided at the housing 21. The open link 28 is operatively connected to the open lever 33 in a rotatable manner. The open lever 33 is attached in a rotatable manner to the housing 21 via a support pin 34. The open lever 33 is stably arranged at a predetermined position by means of a torsion spring (not shown). One end portion 33*a* of the open lever 33 is operatively connected to the connection portion 28*b* of the open link 28 while the other end portion of the open lever 33 positioned opposite to the one end portion 33*a* relative to a rotational center is connected to the outside handle 4. Because of an operation of the outside handle 4 in the open direction, the open lever 33 rotates so that the one end portion 33*a* and further the connection portion 28*b* of the open link 28 are moved upward against the biasing force of the torsion spring.

The open link 28 further includes an L-shaped engagement piece 28*c* between the engagement groove 28*a* and the connection portion 28*b*. The engagement piece 28*c* is arranged in the vicinity of a lift lever 35 attached to the housing 21 in a rotatable manner. The lift lever 35 is connected to the pawl 13 (see FIG. 2) so as to integrally rotate therewith. In cases where the lift lever 35 rotates so that an end portion 35*a* thereof facing the engagement piece 28*c* is moved upward, the engagement of the latch mechanism 11 with the striker 2 is released in association with the rotation of the pawl 13 and the lift lever 35 as a unit, thereby allowing the open operation of the vehicle door 1 relative to the vehicle body.

The engagement piece 28*c* is arranged to face the push piece 23*a* of the inside open lever 23 in the vertical direction in FIG. 3 and is positioned on a rotational locus of the push piece 23*a*. Therefore, when the inside open lever 23 rotates in the counterclockwise direction, the push piece 23*a* presses a facing surface of the engagement piece 28*c*, thereby moving the open link 28 in the upward direction.

A relationship of arrangement between the engagement piece 28*c* and the end portion 35*a* in cases where the active lever 26 is in the unlocked position and the locked position will be explained below. In cases where the active lever 26 is in the unlocked position as illustrated in FIG. 7, the one end of the open link 28 is positioned at one side (i.e., right side in FIG. 7) by means of the engagement pin 27*a* of the panic lever 27. At this time, the engagement piece 28*c* and the end portion 35*a* are positioned to face each other in the vertical direction in FIG. 7. The engagement groove 28*a* is arranged in such a way that the longitudinal direction thereof corresponds to the vertical direction. Accordingly, when the open link 28 is moved upward in the aforementioned manner, the end portion 35*a* is moved upward while being pressed by the engagement piece 28*c* to thereby release the engagement of the latch mechanism 11 with the striker 2. At this time, the open link 28 is positioned in a transmission allowable position.

On the other hand, in cases where the active lever 26 is in the locked position as illustrated in FIG. 4, the one end of the open link 28 is positioned at the other side (i.e., left side in FIG. 4) by means of the engagement pin 27*a* of the panic lever 27. At this time, the engagement piece 28*c* is arranged in such a way that an extended line along the longitudinal direction of the engagement groove 28*a* is prevented from making contact with the end portion 35*a*. According to the present embodiment, when the open link 28 is moved upward along the longitudinal direction of the engagement groove 28*a*, the engagement piece 28*c* is configured to make contact with the lift lever 35 at a sidewall surface in the rear direction of the vehicle. At this time, the open link 28 guided by the engagement pin 27*a* that is inserted into the engagement groove 28*a* is tentatively retained between the panic lever 27 and the lift lever 35. That is, by one upward operation of the open link 28, the end portion 35*a* is not pressed by the engagement piece 28*c*. The engagement of the latch mechanism 11 with the striker 2 is retained. At this time, the open link 28 is in an impossible transmission position.

The lock actuator 29 is driven upon detection of a remote operation of a lock and unlock switch (i.e., lock and unlock operation) provided at a key blade, a door interior trim, and the like at a control circuit (not shown). When the lock actuator 29 is driven, the active lever 26 is selectively moved to the unlocked position and the locked position as described above.

Figure 8:
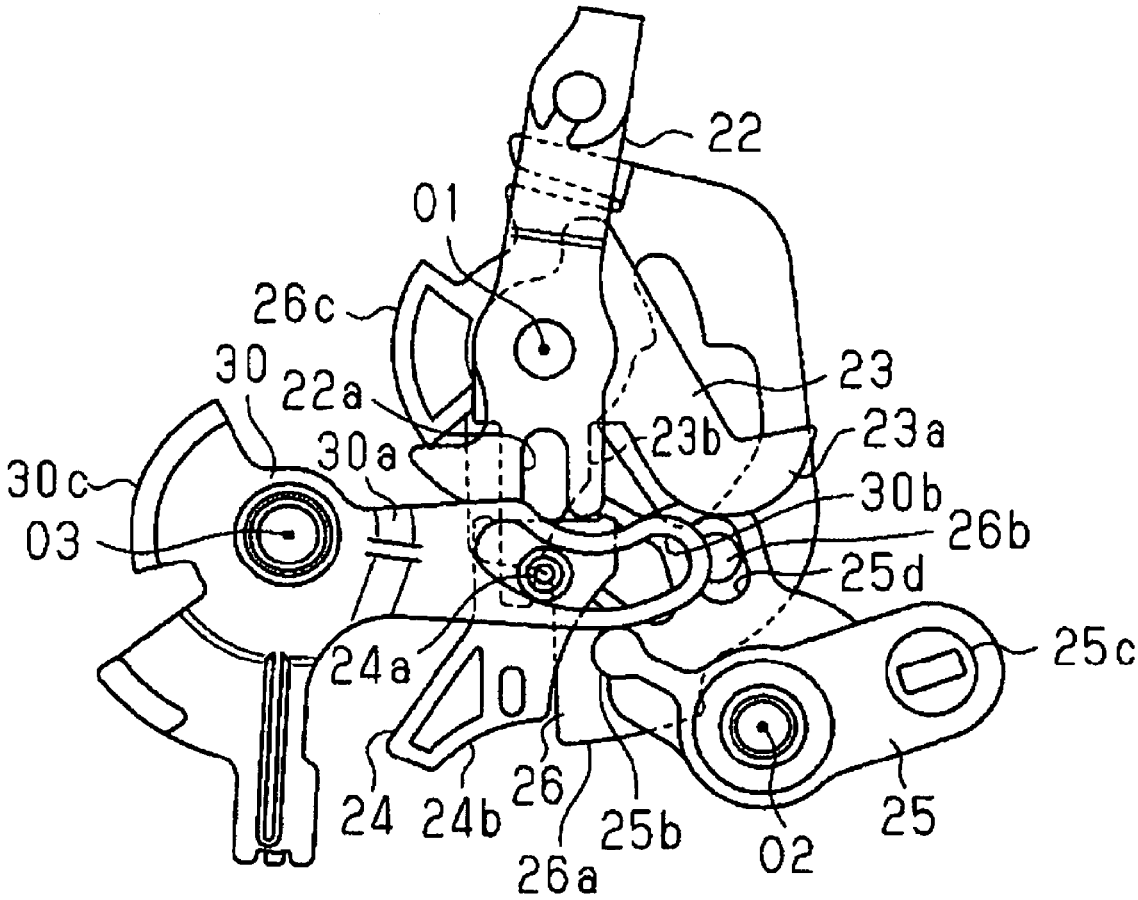
FIG. 8 is a side view illustrating the door lock apparatus and its operation.

The child lock lever 30 is formed by a resin material, for example, and is supported at the housing 21 so as to be rotatable about a rotational axis 03 in the clockwise direction and the counterclockwise direction in FIG. 3 within a predetermined rotational angle. As illustrated in FIG. 7, the child lock lever 30 is in a child lock unset position where the counterclockwise rotation of the child lock lever 30 is restricted. As illustrated in FIG. 8, the child lock lever 30 is in a child lock set position where the clockwise rotation of the child lock lever 30 is restricted. A spring 36 for positioning the child lock lever 30 (see FIG. 3) is attached to the housing 21. The child lock lever 30 is selectively moved to the child lock unset position and the child lock set position by receiving a biasing force of the spring 36.

The child lock lever 30 includes a lever portion 30*a*, a guide bore 30*b*, and a gear portion 30*c*. The lever portion 30*a* extends from its rotational center, i.e., the rotational axis 03, of the child lock lever 30 towards the bush 24 to form into a plate shape. The guide bore 30*b* is formed at the lever portion 30*a* so as to radially extend to form an arc shape. The gear portion 30*c* extends from the rotational center towards the child lock actuator 31 to form a fan shape. The child lock actuator 31 includes an electric motor 31*a* and an output gear portion 31*b* fixed to a rotational shaft of the electric motor 31*a*. The gear portion 30*c* meshes with the output gear portion 31*b* so that the child lock lever 30 and the child lock actuator 31 are connected to each other. The child lock lever 30 is driven by the child lock actuator 31 to be selectively moved to the child lock unset position and the child lock set position.

The engagement projection 24*a* of the bush 24 is inserted into the guide bore 30*b* of the child lock lever 30 so that the radial movement of the engagement projection 24*a* about the rotational axis 01 is restricted by the guide bore 30*b*. That is, the position of the bush 24 relative to the guide piece 23*b* is restricted and determined. In cases where the child lock lever 30 is in the child lock unset position, the bush 24 is configured to be arranged in the child unlock position. In addition, in cases where the child lock lever 30 is in the child lock set position, the bush 24 is configured to be arranged in the child lock position.

When the child lock lever 30 is in the child lock unset position, the guide bore 30*b* having the arc shape is arranged to extend along the circumferential direction relative to the rotational axis 01. Accordingly, the engagement projection 24*a* inserted into the lever portion 30*a* via the engagement groove 22*a* is rotatable about the rotational axis 01. That is, the bush 24 is allowed to rotate. When the inside lever 22 rotates, the engagement projection 24*a* of the bush 24 is pressed by the engagement groove 22*a*, which leads to the bush 24 and the inside open lever 23 that supports the bush 24 to rotate integrally.

The child lock actuator 31 is driven upon detection of a remote operation of a child lock switch (i.e., set and unset operation) provided at a key blade, a door interior trim, and the like at a control circuit (not shown). When the child lock actuator 31 is driven, the child lock lever 30 is selectively moved to the child lock unset position and the child lock set position as described above.

Next, an operation of the door lock apparatus for a vehicle according to the embodiment will be explained below. When the inside lever 22 rotates in the counterclockwise direction in FIG. 4 by an operation of the inside handle 3 in the open direction in a state illustrated in FIG. 4 (i.e., locked state and child lock unset state), the inside open lever 23 that supports the bush 24 of which the engagement projection 24*a* engages with the engagement groove 22*a* integrally rotates with the inside lever 22. The push piece 23*a* of the inside open lever 23 starts to press the engagement piece 28*c* of the open link 28. At this time, since the engagement piece 28*c* of the open link 28 and the end portion 35*a* of the lift lever 35 are prevented from facing each other in the vertical direction in FIG. 3, the end portion 35*a* is not moved upward. Then, as illustrated in FIG. 5, the open link 28 is moved upward by a predetermined amount until the press surface 24*b* of the bush 24 makes contact with the extending portion 25*b* of the cancel lever 25. That is, the inside open lever 23 that supports the bush 24 possesses an idle stroke that is active until the press surface 24*b* makes contact with the extending portion 25*b*. Consequently, the open link 28 is moved upward in advance by means of the idle stroke.

Figure 6:
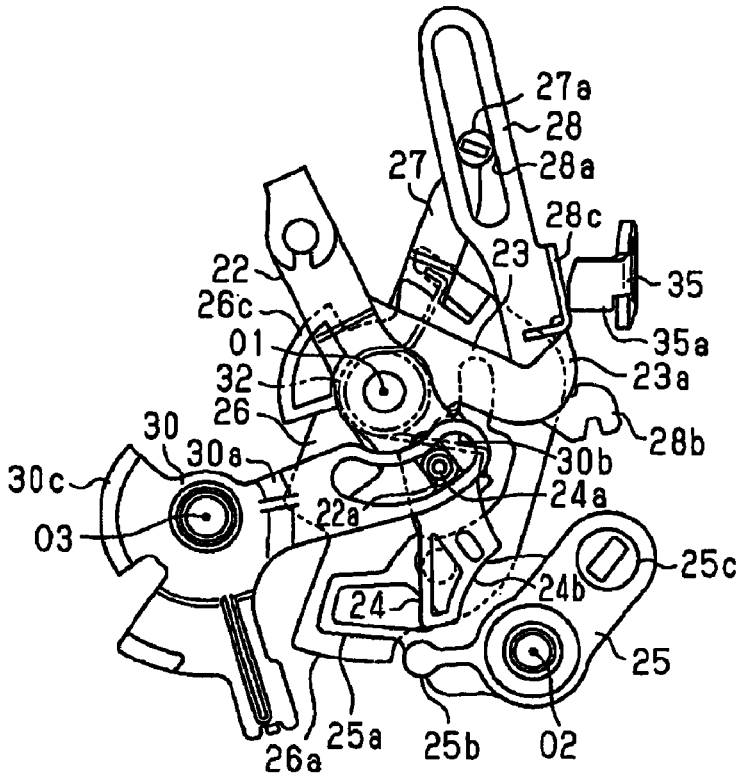
FIG. 6 is a side view illustrating the door lock apparatus and its operation.

When the inside open lever 23 further rotates in the aforementioned state, the open link 28 pressed by the push piece 23*a* is further moved upward. As a result, the engagement piece 28*c* makes contact with the lift lever 35 at the sidewall surface in the rear direction of the vehicle (i.e., the engagement piece 28*c* engages with the lift lever 35) to be tentatively retained and sandwiched between the lift lever 35 and the panic lever 27 as illustrated in FIG. 6. Further, in association with the further rotation of the bush 24 supported by the inside open lever 23, the press surface 24*b* of the bush 24 presses the extending portion 25*b* of the cancel lever 25. As a result, the cancel lever 25 and the active lever 26 integrally rotate about the respective rotational axes 02 and 01. Then, the active lever 26 is moved to the unlocked position by means of the biasing force of the spring for positioning the active lever 26. At this time, the active lever 26 is moved to the unlocked position against the biasing force of the spring 32 while the panic lever 27 that guides the open link 28 is retained, i.e., the panic lever 27 does not integrally rotate with the active lever 26.

When the operation of the inside handle 3 in the open direction is released in the aforementioned state, the inside lever 22 integrally rotates with the inside open lever 23 in the clockwise direction in FIG. 6. Then, the engagement piece 28*c* of the open link 28 is separated from the push piece 23*a*. At this time, since the active lever 26 is already in the unlocked position, the engagement piece 28*c* of the open link 28 that is moved downward while being guided by the panic lever 27 faces the end portion 35*a* of the lift lever 35 in the vertical direction in FIG. 7 (i.e., unlocked state).

Therefore, according to the present embodiment, even when the vehicle door 1 is in the locked state, the vehicle door 1 can be shifted to the unlocked state by the operation of the inside handle 3 in the open direction. As a result, a lock-knob that is conventionally provided in a vehicle interior and that links to a function of an inside locking lever is omitted.

When the inside handle 3 is further operated one more time, the inside lever 22 integrally rotates with the inside open lever 23 in the counterclockwise direction in FIG. 7. Then, the engagement piece 28*c* is pressed by the push piece 23*a* to thereby move the open link 28 upward. As a result, the engagement piece 28*c* presses the end portion 35*a*, which is then moved upward. The engagement of the latch mechanism 11 with the striker 2 is cancelled accordingly. That is, in the locked state of the vehicle door 1, the latch mechanism 11 is operated so that the vehicle door 1 is brought to the open ready state relative to the vehicle body by the double operation of the inside handle 3 (i.e., two motion mechanism).

According to the present embodiment, mechanisms relating to the open operation at the vehicle interior side (i.e., the inside lever 22 and the inside open lever 23) and mechanisms relating to the lock operation (i.e., the active lever 26 and the panic lever 27) are coaxially arranged with each other to thereby aim a downsizing of the door lock apparatus 10 as a whole. The rotation (i.e., operation) directions of the mechanisms relating to the open operation and the mechanisms relating to the lock operation are opposite to each other about the rotational axis 01.

In the cases where the child lock lever 30 rotates in the clockwise direction in the state illustrated in FIG. 7 by the driving force of the child lock actuator 31 to be moved to the child lock set position as illustrated in FIG. 8, the bush 24 is pressed by the guide bore 30*b* to be moved along the guide piece 23*b* of the inside open lever 23 to the child lock position (i.e., the vehicle is in the child lock set position). At this time, the inside lever 22 and the inside open lever 23 are relatively rotatable to each other as mentioned above. Accordingly, even when the inside lever 22 rotates in the counterclockwise direction by the operation of the inside handle 3 in the open direction, the inside lever 22 and the inside open lever 23 are relatively rotatable to each other. That is, even when the inside handle 3 is operated while the child lock lever 30 is in the child lock set position, the inside lever 22 only rotates and the inside open lever 23 does not follow the rotation of the inside lever 22, which prevents the cancellation of the engagement between the latch mechanism 11 and the striker 2.

When the active lever 26 is in the unlocked position, the engagement of the latch mechanism 11 with the striker 2 is released by the operation of the outside handle 4 regardless of the positions of the bush 24 and the child lock lever 30. That is, in the cases where the bush 24 is in the child lock position and the active lever 26 is in the unlocked position, the latch mechanism 11 can be operated so that the vehicle door 1 is allowed to be open relative to the vehicle body by the operation from the outside of the vehicle (i.e., the operation of the outside handle 4) (child lock mechanism).

When the child lock lever 30 rotates in the clockwise direction to be moved to the child lock set position by the driving force of the child lock actuator 31 in the state illustrated in FIG. 4, the bush 24 is moved to the child lock position. In such state, the inside lever 22 and the inside open lever 23 are relatively rotatable to each other with the active lever 26 in the locked position, thereby achieving a so-called double lock state.

In addition, when the cancel lever 25 rotates in the clockwise direction by directly receiving an operating force at the input portion 25*c* from the outside of the door lock apparatus 10 with the active lever 26 in the unlocked position, regardless of the positions of the bush 24 and the child lock lever 30, the active lever 26 that is operated in association with the cancel lever 25 is moved to the locked position by the biasing force of the spring for positioning. Then, the panic lever 27 that guides the open link 28 integrally rotates with the active lever 26 so that the vehicle door 1 is sifted to the locked state. Such feature is provided to enable the vehicle door 1 to be forcedly shifted to the locked state by the operation of the cancel lever 25 even if the lock actuator 29 or the child lock actuator 31, for example, is impossible to be driven.

When the driving of the lock actuator 29 is stopped, the output gear portion 29*b* is released. That is, the lock actuator 29 is not powered and thus the output gear portion 29*b* rotates by following the operation of the active lever 26. Thus, an effect on the operating force required to shift the vehicle door 1 from the locked state to the unlocked state by the operation of the inside handle 3 or the cancel lever 25 in the aforementioned manner is substantially zero.

Further, regardless of the positions of the bush 24 and the child lock lever 30, the vehicle door 1 can be shifted from the locked state to the unlocked state or vice versa by the driving of the active lever 26 by the lock actuator 29.

According to the aforementioned embodiment, the following effects can be obtained. First, the active lever 26 is moved from the locked position to the unlocked position by the operation of the inside open lever 23 (and the bush 24) via only the cancel lever 25. Thus, the transmission efficiency of the operating force is improved when the active lever 26 is moved from the locked position to the unlocked position by the operation of the inside open lever 23 via the inside lever 22 caused by the operation of the inside handle 3.

At this time, prior to the operation start of the active lever 26 via the cancel lever 25 in association with the operation of the inside open lever 23 (and the bush 24), the open link 28 is pressed by the inside open lever 23 so that the open link 28 engages with the lift lever 35. That is, the operation of the open link 28 is started in advance. After the open link 28 engages with the lift lever 35, the active lever 26 is operated independently from the panic lever 27 while the spring 32 is being deflected. As a result, the active lever 26 is movable from the locked position to the unlocked position without the operation of the latch mechanism 11 for bringing the vehicle door 1 to the open ready state by the open link 28.

In addition, according to the aforementioned embodiment, the operation of the inside lever 22 is transmittable to the inside open lever 23 and the cancel lever 25 by the bush 24 that is selectively moved to the child unlock position and to the child lock position so as to serve as a mechanism for allowing and prohibiting the transmission of the operation of the inside lever 22 to the inside open lever 23 (i.e. child lock mechanism). Then, timing to transmit the operation of the inside lever 22 to the inside open lever 23 and the cancel lever 25 is individually specified by means of the bush 24, thereby easily achieving the two motion mechanism.

Further, according to the aforementioned embodiment, the inside lever 22, the inside open lever 23, the active lever 26, and the panic lever 27 are rotatably supported at the vehicle door 1 (i.e., the housing 21) via the identical rotational axis 01. Thus, a space where the inside open lever 23, the active lever 26, and the panic lever 27 are arranged is minimized. The door lock apparatus 10 can be downsized accordingly.

Furthermore, according to the aforementioned embodiment, the bush 24 includes two features that relate to the child lock mechanism and the two-motion mechanism, thereby decreasing the number of components. That is, the two-motion mechanism is achievable by the use of the bush 24 that is already used for the child lock mechanism.

Furthermore, according to the aforementioned embodiment, the vehicle door 1 is shifted from the locked state to the unlocked state by only the operation of the inside handle 3 without a lock-knob that exposes to the outside of the door lock apparatus 10, for example, to the vehicle interior. Thus, the security performance of the vehicle is enhanced. In addition, since a mechanism relating to the operation control of the lock-knob such as a lever can be omitted, the number of components is decreased.

Furthermore, according to the aforementioned embodiment, timing of the operation start of the active lever 26 via the cancel lever 25 in association with the operation of the inside open lever 23 (and the bush 24) and timing of the operation start of the open link 28 may be adjusted, for example, synchronized, to thereby move the latch mechanism 11 in such a way that the vehicle door 1 is shifted to the open ready state by the open link 28 after the active lever 26 is moved from the locked position to the unlocked position. That is, through a simple design change, the vehicle door 1 is shifted from the locked state to the unlocked state by the single operation of the inside handle 3 and is shifted to the open ready state relative to the vehicle body by the operation of the latch mechanism 11 (i.e. one-motion mechanism).

The aforementioned embodiment may be modified as follows. That is, an electromagnetic solenoid may be used for a driving portion of the lock actuator 29 or the child lock actuator 31.

In addition, the child lock mechanism (i.e., the child lock lever 30 and the child lock actuator 31) may be omitted. In this case, the bush 24 may be omitted and then an engagement portion of the bush 24 (i.e., press surface 24*b*) with the cancel lever 25, specifically, the extending portion 25*b*, may be integrally formed with the inside open lever 23.

According to the aforementioned embodiment, the door lock apparatus 10 further includes the bush 24 supported at the inside open lever 23 and transmitting an operation of the inside lever 22 to the inside open lever 23 and the cancel lever 25.

Further, the bush 24 is slidably supported at the inside open lever 23 and is switchable between the child unlock position where the operation of the inside lever 22 is transmittable to the inside open lever 23 and the child lock position where the operation of the open inside lever 22 is not transmittable to the inside open lever 23.

Furthermore, the inside open lever 23 includes the guide piece 23*b* slidably supporting the bush 24, and the bush 24 includes the engagement projection 24*a* that is inserted into the engagement groove 22*a* provided at the inside lever 22 when the bush 24 is in the child unlock position and that is retracted from the engagement groove 22*a* when the bush 24 is in the child lock position.

Furthermore, the cancel lever 25 is switchable between the locked position and the unlocked position in association with the active lever 26, the cancel lever 25 including the extending portion 25*b* extending towards the bush 24, the bush 24 including the push surface 24*b* being able to press the extending portion 25*b*, and the cancel lever 25 is switched from the locked position to the unlocked position by a transmission of the operation of the inside lever 22 to the cancel lever 25 via the push surface 24*b* and the extending portion 25*b* when the bush 24 is in the child unlock position and the cancel lever 25 is in the locked position.

Furthermore, the cancel lever 25 is switchable between the locked position and the unlocked position in association with the active lever 26, the cancel lever 25 including the extending portion 25*b* extending towards the bush 24, the bush 24 including the push surface 24*b* being able to press the extending portion 25*b*, and the cancel lever 25 is switched from the locked position to the unlocked position by a transmission of the operation of the inside lever 22 to the cancel lever 25 via the push surface 24*b* and the extending portion 25*b*.

Furthermore, the door lock apparatus 10 includes the housing 21 adapted to be mounted to the vehicle door 1 and supporting the inside lever 22, the inside open lever 23, the active lever 26, and the panic lever 27 by an identical rotational axis (01) in a rotatable manner.

The panic lever 25 includes the input portion 25*c* directly receiving an operating force from an outside of the door lock apparatus 10.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door lock apparatus for a vehicle, comprising:

a latch mechanism retaining a vehicle door in a closed state relative to a vehicle body;

an open operation lever adapted to operate by operation of an inside door handle provided at the vehicle door;

an open lever operatively connected to the open operation lever;

a locking lever being switchable between an unlocked position and a locked position;

a link operation lever operatively connected to the locking lever by way of a biasing member;

a link member arranged between the latch mechanism and the open lever and operatively connected to the link operation lever, the link member being able to transmit an operation of the open lever to the latch mechanism when the locking lever is in the unlocked position, the latch mechanism being operated to bring the vehicle door to be in an open ready state relative to the vehicle body, the link member being unable to transmit the operation of the open lever to the latch mechanism when the locking lever is in the locked position;

a lever member operatively connected to the open lever through a block member and operatively connected to the locking lever, the lever member moving the locking lever from the locked position to the unlocked position by operation of the open lever;

the block member supported at the open lever to transmit an operation of the open operation lever to the open lever and the lever member;

a rotatable child lock lever positionable in a child lock unset position at which operation of the open operation lever is transmittable to the open lever by way of the block member and positionable in a child lock set position at which operation of the open operation lever is not transmittable to the open lever by way of the block member; and wherein the lever member is switchable between a locked position and an unlocked position in association with the locking lever, the lever member including an extending portion extending towards the block member, the block member including a push surface able to press the extending portion, and the lever member is switched from the locked position to the unlocked position by a transmission of the operation of the open operation lever to the lever member via the push surface and the extending portion.

2. A door lock apparatus according to claim 1, wherein the block member is slidably supported at the open lever and is switchable between a child unlock position where the operation of the open operation lever is transmittable to the open lever and a child lock position where the operation of the open operation lever is not transmittable to the open lever.

3. A door lock apparatus according to claim 2, wherein the open lever includes a guide piece slidably supporting the block member, and the block member includes an engagement projection that is inserted into an engagement groove provided at the open operation lever when the block member is in the child unlock position and that is retracted from the engagement groove when the block member is in the child lock position.

4. A door lock apparatus according to claim 3, wherein the lever member is switchable between a locked position and an unlocked position in association with the locking lever, the lever member including an extending portion extending towards the block member, the block member including a push surface being able to press the extending portion, and the lever member is switched from the locked position to the unlocked position by a transmission of the operation of the open operation lever to the lever member via the push surface and the extending portion when the block member is in the child unlock position and the lever member is in the locked position.

5. A door lock apparatus for a vehicle, comprising:

a latch mechanism retaining a vehicle door in a closed state relative to a vehicle body;

an open operation lever adapted to operate by operation of an inside door handle provided at the vehicle door;

an open lever operatively connected to the open operation lever;

a locking lever being switchable between an unlocked position and a locked position;

a link operation lever operatively connected to the locking lever by way of a biasing member;

a link member arranged between the latch mechanism and the open lever and operatively connected to the link operation lever, the link member being able to transmit an operation of the open lever to the latch mechanism when the locking lever is in the unlocked position, the latch mechanism being operated to bring the vehicle door to be in an open ready state relative to the vehicle body, the link member being unable to transmit the operation of the open lever to the latch mechanism when the locking lever is in the locked position;

a block member supported at the open lever to transmit operation of the open operation lever to the open lever;

a rotatable child lock lever positionable in a child lock unset position at which operation of the open operation lever is transmittable to the open lever by way of the block member and positionable in a child lock set position at which operation of the open operation lever is not transmittable to the open lever by way of the block member;

a lever member operatively connected to the open lever through the block member and operatively connected to the locking lever, the lever member moving the locking lever from the locked position to the unlocked position by operation of the open lever;

a housing adapted to be mounted to the vehicle door and supporting the open operation lever, the open lever, the locking lever, and the link operation lever by an identical rotational axis in a rotatable manner; and wherein the lever member and the locking lever are each rotatable mounted to rotate about respective rotation axes that are spaced apart from one another.

6. A door lock apparatus according to claim 1, wherein the lever member includes an input portion directly receiving an operating force from an outside of the door lock apparatus.

7. A door lock apparatus according to claim 2, wherein the block member engages with the child lock lever.

8. A door lock apparatus according to claim 3, wherein the child lock lever includes a rotational center about which the child lock lever is rotatable, the child lock lever having a lever portion extending outwardly away from the rotational center, the lever portion of the child lock lever being provided with a radially extending guide bore, the engagement projection of the block member being positioned in the guide bore so that radial movement of the engagement projection about a rotational axis of the open operation lever is restricted.

9. A door lock apparatus according to claim 5, wherein the open operation lever, the lever member and the child lock lever are each rotatably mounted to rotate about respective rotation axes that are spaced apart from one another.

10. A door lock apparatus according to claim 1, wherein the child lock lever includes a guide bore in which is positioned the block member.

11. A door lock apparatus according to claim 1, wherein the child lock lever includes a gear part engageable with an output gear portion of an electric motor.

12. A door lock apparatus for a vehicle, comprising:

a latch mechanism retaining a vehicle door in a closed state relative to a vehicle body;

an open operation lever adapted to operate by operation of an inside door handle provided at the vehicle door;

an open lever operatively connected to the open operation lever;

a locking lever being switchable between an unlocked position and a locked position;

a link operation lever operatively connected to the locking lever by way of a biasing member;

a link member arranged between the latch mechanism and the open lever and operatively connected to the link operation lever, the link member being able to transmit an operation of the open lever to the latch mechanism when the locking lever is in the unlocked position, the latch mechanism being operated to bring the vehicle door to be in an open ready state relative to the vehicle body, the link member being unable to transmit the operation of the open lever to the latch mechanism when the locking lever is in the locked position;

a block member supported at the open lever to transmit an operation of the open operation lever to the open lever;

a rotatable child lock lever positionable in a child lock unset position at which operation of the open operation lever is transmittable to the open lever by way of the block member and positionable in a child lock set position at which operation of the open operation lever is not transmittable to the open lever by way of the block member;

a lever member operatively connected to the open lever through the block member and operatively connected to the locking lever, the lever member moving the locking lever from the locked position to the unlocked position by operation of the open lever; and wherein the lever member includes a through bore, and the locking lever includes a connecting projection portion positioned in the through bore of the lever member.

13. A door lock apparatus according to claim 5, wherein the lever member includes an input portion directly receiving an operating force from an outside of the door lock apparatus.

14. A door lock apparatus according to claim 5, wherein the child lock lever includes a gear part engageable with an output gear portion of an electric motor.

15. A door lock apparatus according to claim 12, wherein the lever member includes an input portion directly receiving an operating force from an outside of the door lock apparatus.

16. A door lock apparatus according to claim 12, wherein the child lock lever includes a gear part engageable with an output gear portion of an electric motor.

* * * * *